United States Patent [19]

Hortig

[11] 3,939,685

[45] Feb. 24, 1976

[54] MECHANISM FOR CENTERING METAL HOLLOW BODIES DURING A DRAWING OPERATION

[75] Inventor: Wilhelm Hortig, Auerbach, Germany

[73] Assignee: KM Engineering AG, Basel, Switzerland

[22] Filed: Sept. 16, 1974

[21] Appl. No.: 506,657

[30] Foreign Application Priority Data

Sept. 19, 1973 Switzerland ..... 13466/73

[52] U.S. Cl. ..... 72/361

[51] Int. Cl.[2] ..... B21D 22/30

[58] Field of Search ..... 72/347, 348, 349, 361

[56] References Cited

UNITED STATES PATENTS

| | | | |
|---|---|---|---|
| 2,731,860 | 1/1956 | Schaming | 72/361 |
| 2,851,980 | 9/1958 | Kralcinski | 72/361 |

FOREIGN PATENTS OR APPLICATIONS

| | | | |
|---|---|---|---|
| 122,935 | 8/1901 | Germany | 72/361 |

*Primary Examiner*—Milton S. Mehr
*Attorney, Agent, or Firm*—Neil F. Markva

[57] ABSTRACT

A mechanism for centering metal hollow bodies during a drawing operation is disposed in front of a die of an ironing tool. The metal hollow bodies each have a flared section along the edge zone of its open face. The mechanism comprises at least two centering-cheeks adapted to the circumference of the metal hollow body. The centering-cheeks are movably supported for sliding movement within a plane extending transversely to the tool axis and in any direction towards or away from the tool axis. Mechanical control means effect periodic opening motion of the centering-cheeks in any direction away from the tool axis in dependence upon the motion of a draw punch. The control means are effective to cause the two centering-cheeks to embrace the hollow body centeringly after it has been thrust into the die by the draw punch and at at least a fraction of its overall height. The control means includes means for withdrawing the centering-cheeks away from the hollow body at a time just before the flared section passes thereby and by at least the radial dimension of the flared section from the circumference of the hollow body.

6 Claims, 6 Drawing Figures

MECHANISM FOR CENTERING METAL HOLLOW BODIES DURING A DRAWING OPERATION

BACKGROUND OF THE INVENTION

The present invention refers to a mechanism for centering drawn hollow bodies in front of or above the die of a tool set consisting of a number of tools independent of one another, where each hollow body has a flared section in the edge zone of its open face.

In the non-cutting forming of metal hollow bodies which, for example, are employed for the production of tins or other metal containers, a circular blank stamped out of the original material is brought through a number of stages of shaping into the desired final shape of hollow body. The hollow-body blank designated in the description below as a semi-form is in that case conveyed by conveyor members, for example, grippers controlled in step with the press, from one shaping-station to another and shaped in stages. In that case, it is for the success of the shaping process of the highest importance that the semi-form gets centered, in front of or respectively above the die, i.e., shortly before the start of the shaping.

For certain reasons which are connected, e.g., with troublefree stripping of the semi-form from the punch and in particular are explained in the Swiss patent application No. 7570/73, it has proved advantageous to apply a flared section in the edge zone of the open face of the semi-form. The flared section in cylindrical semi-forms has essentially the shape of a flat truncated cone. As described in said Swiss Patent Application, the flared section at the top edge of the semi-form is applied deliberately in the course of shaping, in order to guarantee trouble free stripping of the semi-form from the ironing-punch in spite of extremely high stroke frequency and small thickness of wall. More recently, as shown in Swiss patent application No. 1977/72, stroke frequencies between 140 and 200 strokes per minute have become possible. The semi-forms are stretched to a wall thickness of about 0.1 mm. It now becomes clear that the special shape of the edge demands a special technical solution since the flared edge must under no circumstances get damaged or distorted.

The hollow bodies provided with a flared edge portion of the type described can no longer be centered by the conventional stationary centering ring. Otherwise, the flared section would collide with the centering ring arranged above or in front of the die and consequently be damaged. Centering mechanisms are indeed known in which spring-loaded centering members are forced away radially outwardly by the projecting and flared edge portion of the semi-form. Thus, the deflection motion of the centering members in that case is not effective forcibly, but only under the pressure of the flared edge portion itself encountering the centering members. This type of construction, therefore, can only be employed by fairly small, relatively compact semi-forms of about 16 to 20 mm diameter. That is, only this size of a flared edge portion can withstand the resilient prestressing of the centering members without permanent deformation.

For semi-forms of larger diameters and having extremely thin walls, very delicate hollow bodies are obtained by new methods of production. These known centering mechanisms are totally unusable. During their employment, deformation of the very flexible and thin walls of the hollow bodies cannot be avoided.

Furthermore, the high stroke rate attendant the new methods of production could not be achieved when these known centering mechanisms were in use.

SUMMARY OF THE INVENTION

Disadvantages of the known centering mechanisms are eliminated through the use of the present invention. The mechanism forming the object of the invention is characterized by at least two movably supported centering-cheeks adapted to the circumference of the hollow body. The centering-cheeks slide within a plane running transversely to the tool axis and in a direction toward the tool axis or respectively away from it. The periodic opening of the centering-cheeks is directed away from the tool axis and is forcibly controlled in dependence upon the motion of the draw-punch in such a way that the two centering-cheeks embrace the hollow body centeringly at at least a fraction of its overall height and after the hollow body has been thrust into the die by the draw-punch. Then, at the latest moment shortly before passing by the flared edge-section, the centering-cheeks withdraw from the circumference of the hollow body by at least the radial dimension of the flared section.

In a specific embodiment of this mechanism, each centering-cheek has a bevelled shoulder sloping downwardly toward the tool axis as well as a perforation arranged in front of the bevelled shoulder. An actuator-rod is guided in the die-housing projects through the perforation and likewise has a bevel. The bottom section of the actuated-rod is connected operatively on the one hand with the draw punch. On the other hand, the rod is connected with the reset member in such a way that the actuated-rod, toward the end of the working stroke of the draw punch, is moved outwardly and thereby forces outwardly the centering-cheek associated with it.

Advantageously, the main ejector supported slidingly in the die-housing is produced in two parts and includes one section supported to be freely slidable above the crossbar as well as one rod lying under resilient prestress. The main ejector is guided concentrically with the crossbar and upon its ejection motion lies against the aforesaid section and slides this way in front of it. The crossbar has a central bore having a cross-section that is greater than that of the top part of the rod but smaller than the area facing the crossbar of the said section.

BRIEF DESCRIPTION OF DRAWINGS

One embodiment of the object of the invention is illustrated in the attached drawing.

FIG. 1*b* is a view along line *b—b* of FIG. 1*a* showing a top plan of the bottom part of the tool with the conveyor members removed.

DESCRIPTION OF SPECIFIC EMBODIMENTS

Figure 1A:
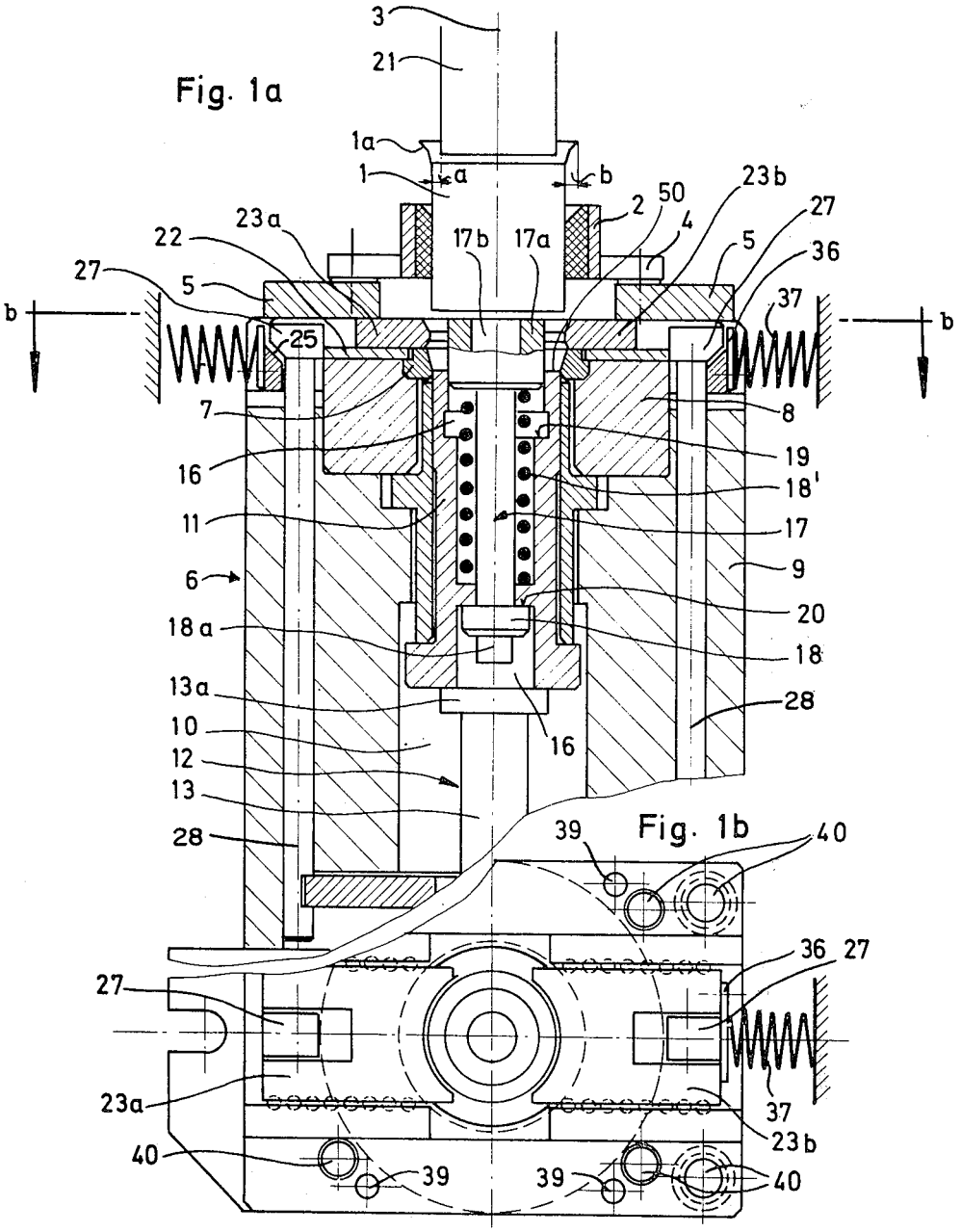
FIG. 1*a* is a simplified vertical section through an ironing-tool.

More specifically, referring to the drawings, FIG. 1*b* shows the top plan of the bottom portion of an ironing tool on which an already preshaped cylindrical body 1 for a tin is getting subjected to a further shaping operation. The body 1 is held by a pair of draw-tongs 2 which conveys it from the preceding shaping-station to a position in front of the die of the tool illustrated. The longitudinal axis of body 1 practically coincides with the axis 3 of the tool. The grips of the draw-tongs 2 are fastened in known manner to spring-loaded tong-arms 4 which in turn are arranged pivotally on a bearer-bar 5 moved to and fro periodically. The contructional details of this draw-tongs mechanism are in themselves known and for the present context of secondary significance, so that their description and illustration in detail are omitted.

The bottom part of a tool, generally designated 6, includes as its most important part an ironing ring 7 which is fixed in an annular recess in an armor ring 8. The armor ring 8 is in turn supported in a bore in the tool housing 9.

Figure 3:
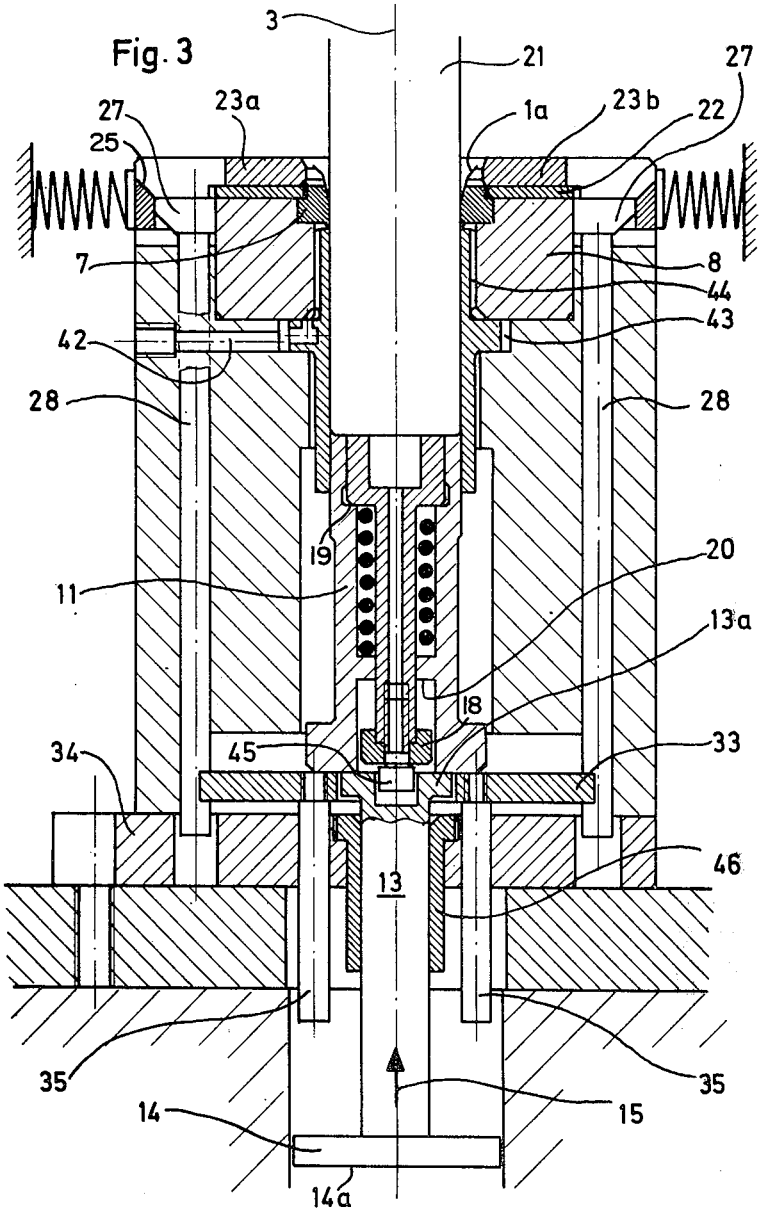
FIG. 3 shows the same tool arrangement in a further phase of operation.

The tool housing 9 includes a central stepped bore 10 in which the top section 11 of the main ejector, generally designated 12, is supported to be able to slide freely. The bottom part of the main ejector 12 comprises an injector rod 13 and ejector section 11. The injector rod 13 rests with its head portion **13*a* against the underside of the ejector section 11 and has at its bottom end section a piston plate 14 (FIG. 3). A resilient medium loads the underside 14*a* of the piston plate 14. The resilient medium in this specific embodiment is compressed air which continuously tries to force the piston plate 14 and, with it, the ejector rod 13 and the ejector section 11 upwardly in the direction of the arrow 15**.

The top ejector section 11 is supported to slide freely and has a stepped bore 16 inside which is arranged an auxiliary ejector 17 which, in itself, is known. The auxiliarly ejector 17 includes a stop collar 18 and a head portion **17*a* with a holder magnet 17*b*. Ejector 17 is subjected to the action of a compression spring 18' and can be moved to and fro between two end positions. In one end position, the head portion 17*a* encounters the shoulder 19 in bore 16 as shown in FIG. 3. In the other end position illustrated in FIG. 1*a*, the top annular surface of the stop collar 18 is in contact with the underside of the shoulder face 20**.

To produce the required shaping, the semi-form 1 must be thrust by an ironing punch 21 moved periodically to and fro downwardly through the opening in the ironing ring 7. Therefore, the centering of semi-form 1 with respect to the tool axis 3 plays an extraordinarily important part. The ironing punch 21, because of the difference in diameter **2*a*, cannot center the semi-form 1. Furthermore, the wall thickness of the semi-form 1** is very small. Consequently, small deviations from the coaxial position will cause unpleasant damage. Therefore, the centering mechanism has been developed to guarantee this centering operation.

Figure 4:
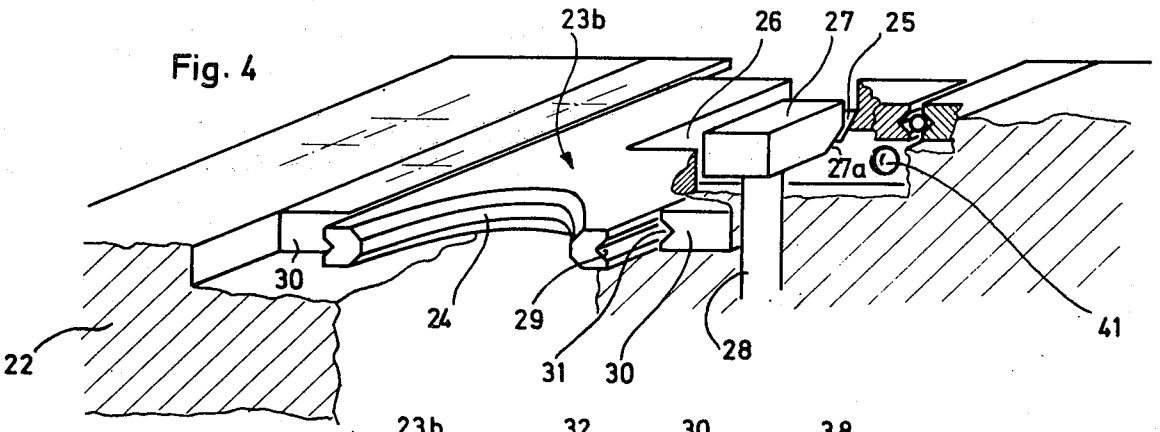
FIGS. 4 and 5 illustrate constructional details.
Figure 5:
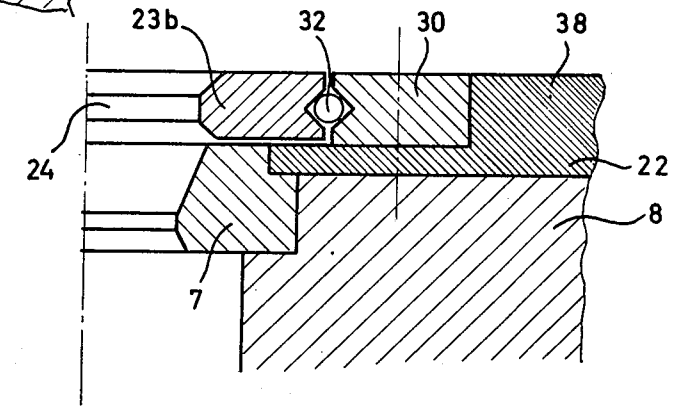

The centering mechanism of this invention includes two centering-cheeks **23*a* and 23*b*. These centering-cheeks are movably mounted within a plane running transversely to the tool axis 3 to slide in a direction toward the tool axis 3 or, respectively, away fron it. As shown in FIGS. 4 and 5, each centering-cheek 23*a* and 23*b*, includes the recess 24 adapted to the circumference of the semi-form 1 and a beveled shoulder 25 at its end section opposite to the tool axis 3. A cam 27 of an actuator rod 28 projects through a perforation 26 that is located in the front of the beveled shoulder 25. The two longitudinal faces of each centering-cheek 23*a* and 23*b* has guide grooves 29** having a prismatic shape.

Two guide rails 30 have longitudinal faces of prismatic shape that are arranged on opposite sides of and face the centering-cheeks **23*a* and 23*b*. The two guide grooves 29 and 31 point toward one another thereby forming a prismatic guide channel in which a row of bearing balls 32 are arranged. The centering-cheeks 23*a* and 23*b* can, therefore, because of the rolling friction, move to and fro very easily at high frequency with the advantage that they cannot saponify or resinify with lubricant and consequently are constantly ready for operation. The centering-cheeks 23*a* and 23*b* are held by bearing balls 32 in such a way that they are suspended at a small clearance above the cover plate 22. See FIG. 5**.

The mechanical control of the centering-cheeks **23*a* and 23*b* is in dependence upon the working rhythm of the ironing punch 21. See particularly FIG. 3. Each actuator rod 28 has a cam 27 and is fixed at its bottom end section to a crossbar 33 from which two rods 35 project downwardly through a base plate 34. The rods 35 in fact improve the guidance of the crossbar 63 during its periodic motion. More importantly, rods 35 transmit to the crossbar 33 the force exerted on the piston plate 14 by the compressed air and also prevent the crossbar 33 from snapping out of notches located in rods 28**.

Crossbar 33 has a central core which is so dimensioned that the head **13*a* of the ejector rod 13 can readily pass therethrough. The bottom annular face of the section 11 of a main ejector is so dimensioned that it rests by an inner annular section on the head 13*a* but by its peripheral portion on the top face of the crossbar 33**.

As shown in FIG. 1A, at the back of each centering-cheek **23*a* and 23*b*, a spring plate 36 bears against the one end section of a compression spring 37**.

Figure 2:
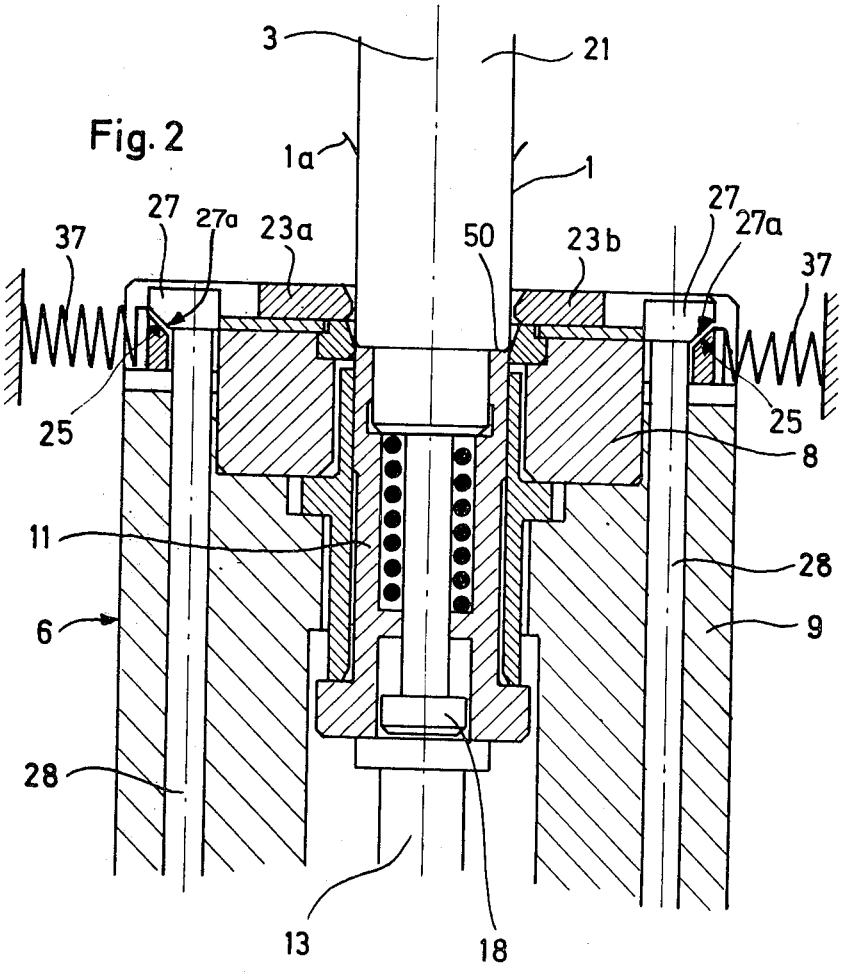
FIG. 2 shows the tool arrangement in accordance with FIG. 1*a* in another phase of operation.

In operation, as soon as the ironing punch 21 has entered a little way into the semi-form 1, the draw tongs 2 are withdrawn from the circumference of the semi-form 1. Then the punch 21 forces the semi-form 1 downwardly through the opening in the ironing ring 7. Two centering-cheeks **23*a* and 23*b* exactly center the semi-form 1 before it encounters the drawing edge of the ironing ring 7. The semi-form 1 is now lying on the front section of ironing punch 21 during its downward motion. Ironing punch 21 forces the head 17*a* of the auxiliary ejector 17 downwardly until its bottom annular edge portion lies against the shoulder 19 in the bore. The shaping of the semi-form 1 has not yet begun during this intermediate phase as illustrated in FIG. 2**.

The ironing punch 21 moving on downwardly now encounters the top annular face 50 of the section 11. Consequently, the main ejector 12 and ejector rod 13 is formed downwardly. The resilient counterpressure of the compressed air acting on the piston plate 14 guarantees a secure hold of the semi-form 1 against the bottom section of the ironing punch 21. As soon as the bottom phase of the section 11 of the main ejector now encounters the cross bar 33 (FIG. 3), the two actuator rods 28 are drawn downwardly by the cross bar 33. Thereupon, the bevel faces **27*a* slide against the bevel shoulders 25 and force the two centering-cheeks 23*a* and 23*b* radially outwardly until they have reached the end position illustrated in FIG. 3**.

This opening motion of the centering-cheeks **23*a* and 23*b* must obviously occur before the flared section 1*a* at the top edge of the semi-form 1 arrives into the zone of the centering-cheeks. The radial opening stroke of the centering-cheeks 23***a* and 23*b* must correspond at least to the radial flare designated in FIG. 1*a* by *b*.

On the return stroke of the ironing punch 21, the main ejector 13 also moves upwardly with it. Toward the end of the stroke, the piston plate 14 encounters the bottom faces of the rods 35 and brings the cams 27 via the cross bar 33 and the actuator rods 28 into their starting position again as shown in FIG. 1*a*.

The function of the auxiliary ejector 17 is in the present context of secondary significance. However, it is relatively important that the compression spring 18 of the auxiliary ejector 17 is not selected to be too strong. That is, spring 18 should yield very easily to the pressure of the ironing punch 21 coming from above. Thus, the centering of the semi-form 1 during the entry of the ironing punch 21 can occur without deformation of the semi-form 1.

The opening of the centering-cheeks 23*a* and 23*b* advantageously occurs about 15 mm. before reaching bottom dead center.

Feed of the lubricant-coolant is effected via a radial channel 42 (FIG. 3) which is connected with the annular space 43 and grooves 44.

As further shown in the sectional illustration as FIG. 3, the stop-collar 18 of the auxiliary ejector 17 is bolted by means of a bolt 45 onto the stank of the auxiliary ejector. The ejector rod 13 is supported by a guide-bush 46 in the baseplate 34.

I claim:

1. A mechanism for centering drawn metal hollow bodies in front of a die of an ironing tool where each metal hollow body has a flared section along the edge zone of its open face, said mechanism comprising:

a. at least two centering-cheeks adapted to the circumference of the metal hollow body, b. said centering-cheeks being movably supported for sliding movement within a place extending transversely to the tool axis and in a direction toward and away from the tool axis, c. a crossbar disposed across the bottom of a housing for the die, d. a main ejector slidingly supported in the die housing, e. said main ejector including a freely slidable section disposed above the crossbar and a rod lying under resilient prestress, f. said rod being guided concentrically with the crossbar and including an area portion which, upon ejection motion of the rod, lies against said slidable section to cause said section to slide away in front of the rod, g. said crossbar having a central bore with a cross section which is greater than that of the top part of the rod but smaller than said area portion facing the crossbar of said slidable section, and h. mechanical control means for effecting periodic opening motion of said centering-cheeks in a direction away from the tool axis in dependence upon the motion of a draw punch, i. said control means being effective to cause the centering-cheeks to embrace the hollow body centeringly at at least a fraction of its overall height and after it has been thrust into the die by the draw punch, j. said control means including means for withdrawing said centering-cheeks away from the circumference of the hollow body at a time just before said flared section passes thereby and by an amount equal to at least the radial dimension of the flared section.

2. A mechanism as defined in claim 1 wherein said rod has a compressed-air-operated piston plate disposed at its end section and at least two guide and actuation rods projecting downwardly from the crossbar are located within the path of the stroke of said piston plate.

3. A mechanism for centering drawn metal hollow bodies in front of a die of an ironing tool where each metal hollow body has a flared section along the edge zone of its open face, said mechanism comprising:

a. at least two centering-cheeks adapted to the circumference of the metal hollow body, b. said centering-cheeks being movably supported for sliding movement within a place extending transversely to the tool axis and in a direction toward and away from the tool axis, and c. mechanical control means for effecting periodic opening motion of said centering-cheeks in a direction away from the tool axis and in dependence upon the motion of a draw punch.

d. said control means being effective to cause the two centering-cheeks to embrace the hollow body conteringly at at least a fraction of its overall height and after if has been thrust into the die by the draw punch, e. said control means including means for withdrawing said centering-cheeks away from the circumference of the hollow body at a time just before said flared section passes thereby and by an amount equal to at least the radial dimension of the flared section.

4. A mechanism as defined in claim 3 wherein each centering-cheek has a bevelled shoulder sloping downwardly toward the tool axis and a perforation which is arranged in front of said bevelled shoulder, said control means includes the actuator rod guided in the die housing and projecting through said perforation, said rod includes a bevel at the top thereof and a bottom section connected operatively on the one hand with the draw punch and on the other hand with a reset member, whereby the actuator rod is moved downwardly toward the end of the working stroke of the draw punch and thereby forces outwardly the centering-cheek associated with it.

5. A mechanism as defined in claim 3 wherein the centering-cheeks are disposed diametrically opposite one another with means for spring biasing the cheeks toward each other, the longitudinal faces of the cheeks having guide members which cooperate with correspondingly shaped guide rails arranged on both sides of each centering-cheek.

6. A mechanism as defined in claim 5 wherein bearing balls run in guide grooves formed between the longitudinal cheek faces and the guide rails of prismatic shape.

* * * * *